US007404357B2

(12) United States Patent
Knabe

(10) Patent No.: US 7,404,357 B2
(45) Date of Patent: Jul. 29, 2008

(54) DEVICE FOR PRESSING ON A FLEXIBLE PRINTING FORM WHEN IT IS BEING PULLED ONTO A FORM CYLINDER OF AN OFFSET PRINTING PRESS

(75) Inventor: Alexander Knabe, Heidelberg (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 213 days.

(21) Appl. No.: 11/452,634

(22) Filed: Jun. 14, 2006

(65) Prior Publication Data

US 2007/0044671 A1 Mar. 1, 2007

(30) Foreign Application Priority Data

Aug. 31, 2005 (DE) ..... 10 2005 041 337

(51) Int. Cl.
*B41F 1/28* (2006.01)

(52) U.S. Cl. ..... 101/415.1; 101/217; 101/409

(58) Field of Classification Search ..... 101/216, 101/217, 230, 375, 376, 377, 408, 409, 415.1
See application file for complete search history.

(56) References Cited

U.S. PATENT DOCUMENTS

| | | | | |
|---|---|---|---|---|
| 4,014,260 | A * | 3/1977 | Schroter-Dommes et al. | 101/212 |
| 4,063,803 | A * | 12/1977 | Wright et al. | 359/894 |
| 4,183,299 | A * | 1/1980 | Cappel | 101/415.1 |
| 4,217,824 | A * | 8/1980 | Rebel et al. | 101/375 |
| 5,809,881 | A * | 9/1998 | Deschner et al. | 101/132 |
| 5,960,716 | A | 10/1999 | Schaede | |
| 6,000,336 | A * | 12/1999 | Leib | 101/409 |

FOREIGN PATENT DOCUMENTS

| | | |
|---|---|---|
| DE | 1 143 210 | 8/1961 |
| DE | 42 23 583 A1 | 1/1994 |
| DE | 197 31 843 A1 | 4/1998 |
| DE | 197 47 478 A1 | 4/1999 |
| DE | 102 46 070 A1 | 5/2003 |
| DE | 20 2004 018 313 U1 | 2/2005 |
| WO | WO 97/29912 | 8/1997 |

* cited by examiner

*Primary Examiner*—Ren Yan
(74) *Attorney, Agent, or Firm*—Laurence A. Greenberg; Werner H. Stemer; Ralph E. Locher

(57) ABSTRACT

A device for pressing on a flexible printing form when it is being pulled onto a form cylinder of an offset printing press. The device makes it possible to use an offset cylinder which is not in phase. The device for pressing on a flexible printing form when it is being pulled onto a form cylinder of an offset printing press, has a switching-on or switching-off apparatus of an offset cylinder with respect to the axially parallel form cylinder and an axially parallel impression cylinder, the offset cylinder having a channel, above which a cover is arranged, and the impression cylinder having a gripper system for sheets. The gripper system protrudes beyond the circumferential contour of the impression cylinder and dips into the channel of the offset cylinder during printing. The surface of the cover has support surfaces for the printing form which supplement the contour of the offset cylinder, and the cover has cutouts or depressions which lie deeper and in the circumferential direction to allow the gripper system to dip into.

6 Claims, 5 Drawing Sheets

DEVICE FOR PRESSING ON A FLEXIBLE PRINTING FORM WHEN IT IS BEING PULLED ONTO A FORM CYLINDER OF AN OFFSET PRINTING PRESS

BACKGROUND OF THE INVENTION

Field of the Invention

The invention lies in the printing technology field. More specifically, the invention relates to a device for pressing on a flexible printing form when it is being pulled onto a form cylinder of an offset printing press. The press has a switching-on or switching-off apparatus of an offset cylinder with respect to the axially parallel form cylinder and an axially parallel impression cylinder, the offset cylinder having a channel, above which a cover is arranged, and the impression cylinder having a gripper system for sheets, which gripper system protrudes beyond the circumferential contour of the impression cylinder and dips into the channel of the offset cylinder during printing.

In offset printing presses, it is known from German published patent application DE 102 46 070 A1, when clamping a printing foil onto a form cylinder, to set the adjacent offset cylinder against the printing foil and to drive it at a differential speed to the form cylinder. The differential speed is so small that the offset cylinder becomes asynchronous with the form cylinder or an impression cylinder by only a few degrees.

German published patent application DE 42 23 583 A1 describes a printing press in which the plate cylinders can be rotated independently of one another into any desired position for a plate change. Clutches are provided between a continuous gear train and the plate cylinders, which clutches make it possible to position all the plate cylinders into a uniform plate changing position. For the simultaneous plate change on all printing units, the plate cylinders are driven synchronously by auxiliary motors or via the gear train. The offset cylinders which are adjacent to the plate cylinders can be set against a new printing plate when it is being pulled on. As a result, a printing plate is smoothed on the surface of the form cylinder. If the plate cylinders are rotated relative to the offset cylinders during the setting of the uniform plate changing position, the cylinder channels no longer come into contact with one another as in printing operation. It is possible for a channel region of an offset cylinder to roll over the printing plate which is to be pulled on. The printing plate is therefore no longer smoothed correctly onto the plate cylinder or is even damaged when it is being pulled on.

Instead of an offset cylinder, it is known from German published patent application DE 197 47 478 A1 to pull on a printing plate by way of a roller which has running rings made from an elastic material on its sides. A pressure roller requires additional installation space and an apparatus for setting it against and removing it from a plate cylinder.

German published patent application DE 197 31 843 A1 describes a removable channel cover for a blanket cylinder which is secured on the end sides of the blanket cylinder with resiliently arranged bolts. The channel cover comprises a torsionally rigid housing which has a cross section in the shape of a circular section. The channel cover has only one function of protecting the channel. In the radial direction, the channel cover lies below the circumferential contour of the blanket cylinder.

SUMMARY OF THE INVENTION

It is accordingly an object of the invention to provide a device for pressing on a flexible printing form when it is being pulled onto a form cylinder of an offset printing press, which overcomes the above-mentioned disadvantages of the heretofore-known devices and methods of this general type and which renders it possible to use an offset cylinder which is not in phase.

With the foregoing and other objects in view there is provided, in accordance with the invention, a device for pressing on a flexible printing form when it is being pulled onto a form cylinder of an offset printing press. The device comprises:

a switching-on or switching-off apparatus of the offset cylinder with respect to an axially parallel form cylinder and an axially impression cylinder;

the offset cylinder having a channel formed therein, and a cover disposed above the channel;

the impression cylinder having a gripper system for sheets, the gripper system protruding beyond a circumferential contour of the impression cylinder and dipping into the channel formed in the offset cylinder during printing;

the cover having a surface formed with support surfaces for supporting the printing form and supplementing a contour of the offset cylinder, and the cover having depressions formed therein lying deeper than the support surfaces and extending in the circumferential direction, enabling the gripper system to dip into the depressions.

In other words, the objects of the invention are achieved in that a cover of a channel of the offset cylinder is configured as a support for a printing form when it is being pulled onto a form cylinder. The support surfaces of the cover lie at the radial height of the effective diameter of the elastic cover of the offset cylinder. The support surfaces bridge the channel as far as possible. The cover has cutouts which lie deeper in the circumferential direction, into which grippers of a gripper system of an adjacent impression cylinder can dip. If the cover is of symmetrical design, an inverted installation into the offset cylinder is possible.

In accordance with an added feature of the invention, the support surface elements can be adjusted radially into two different positions. In a first position, the support surface elements lie under the effective diameter of the offset cylinder during printing operation. In the second position, the support elements are moved out to the effective diameter of the offset cylinder in order to pull on the plate. The support surface elements can comprise a pneumatically or hydraulically expandable material. Furthermore, the support surface elements can be moved out or withdrawn in a purely mechanical manner, for example with a spring-loaded plunger.

In accordance with a concomitant feature of the invention, the cover is formed of an elastic material which also lies radially on the effective diameter of the offset cylinder during printing operation. The material has such a high compliance that no disruptions occur if the material comes into contact with elements in the channel of the plate cylinder or impression cylinder.

Other features which are considered as characteristic for the invention are set forth in the appended claims.

Although the invention is illustrated and described herein as embodied in a device for pressing on a flexible printing form when it is being pulled onto a form cylinder of an offset printing press, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
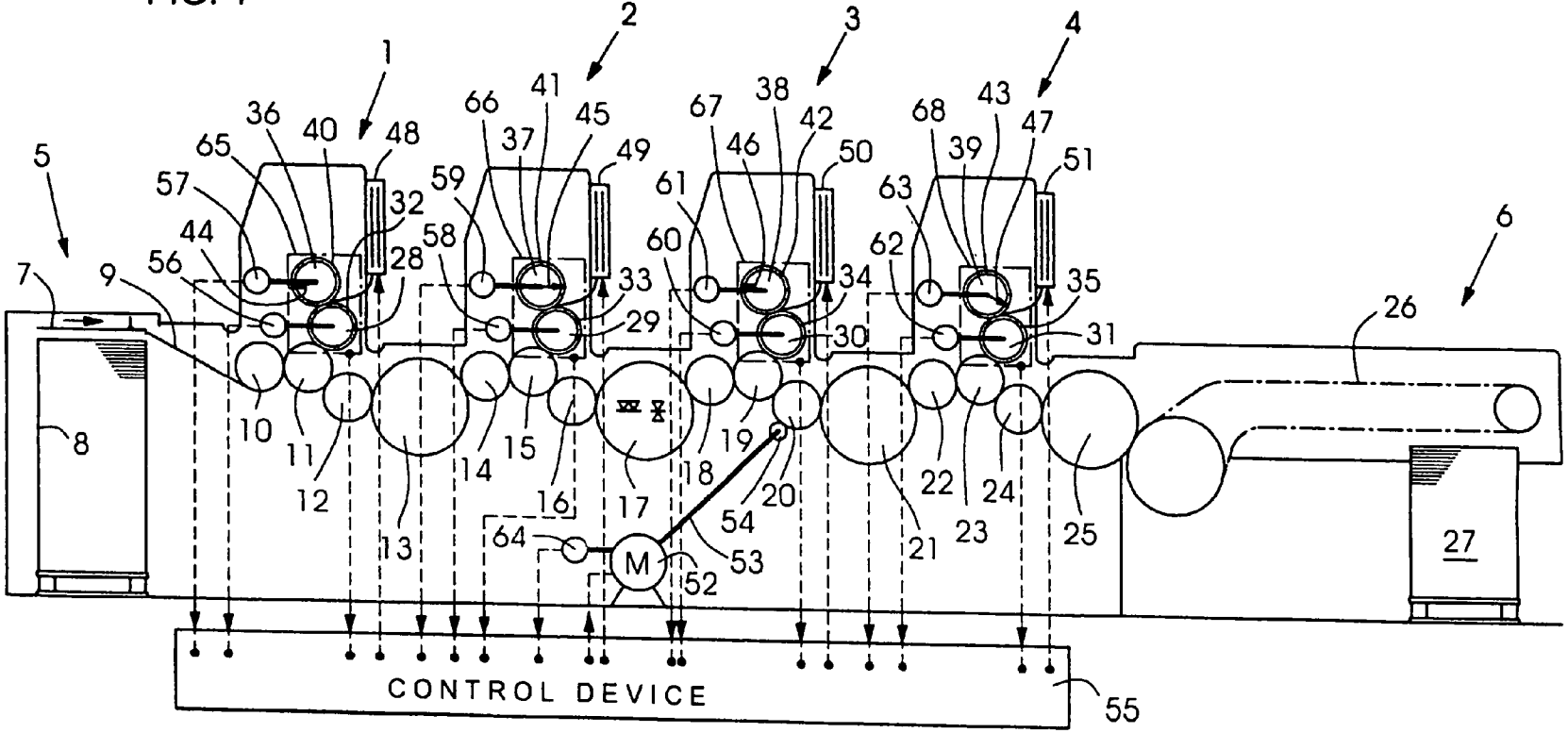
FIG. 1 is a side elevational diagrammatic view of a sheet-fed offset printing press of inline construction, with printing form cylinders in the phase position during printing.

Referring now to the figures of the drawing in detail and first, particularly, to FIG. 1 thereof, there is seen a sheet-fed offset printing press having four printing units 1, 2, 3, and 4 of inline construction. A feeder 5 is disposed ahead of the printing unit 1. A delivery 6 is arranged behind the printing unit 4. During printing, sheets 7 are separated from a feeder stack 8 and are conveyed via a table to a feed drum 10 of the printing unit 1. A sheet 7 is conveyed farther through the printing press with the aid of an impression cylinder 11, drums 12-14, an impression cylinder 15, a transport drum 16, a storage drum 17, a turner drum 18, an impression cylinder 19, transport drums 20-22, an impression cylinder 23 and transport drums 24, 25. The sheets 7 are conveyed from the transport drum 25 to a delivery stack 27 by wy of a chain gripper system 26. All the cylinders or drums 10-25 which convey sheets 7 have gripper systems that hold the sheets at the leading edges and are coupled to one another in a main drive gear train.

Each of the printing units 1-4 comprises a transfer cylinder 28-31 having rubber blankets 32-35 which are in contact with a sheet 7 on the impression cylinders 11, 15, 19, 23 during printing. Furthermore, each printing unit 1-4 comprises plate cylinders 36-39 having clamped printing plates 40-43 which are in contact with the rubber blankets 32-35 during printing. The transfer cylinders 28-31 can be set against and removed from the impression cylinders 11, 15, 19, 23 and the plate cylinders 36-39 by way of apparatuses. The plate cylinders 36-39 have channels which extend parallel to the rotational axis and in which clamping rails are arranged for accommodating the leading edge and trailing edge of the printing plates 40-43. During printing, the channels of the plate cylinders 36-39 have different rotational positions which are shown symbolically with the arrows 44-47. A plate feeding and removal unit 48-51 is fastened to every printing unit 1-4.

The printing machine, or press, is equipped with a turner apparatus, in order to make printing possible on both sides of a sheet 7. The transport drum 16, the storage drum 17 and the turner drum 18 are constituent parts of the turner apparatus. The printing press comprises a main drive motor 52 which is connected to the drive gearwheel of the transport drum 20 via a gear mechanism 53 and a pinion 54.

In order to control the press during printing operation and during the plate change, a control device 55 is provided. The control device 55 is connected to rotary encoders 56-63, the output signals of which represent the rotational position of the transfer cylinders 28-31 and the plate cylinders 36-39. A further rotary encoder 64 supplies the rotational position of the drive shaft of the main drive motor 52. Furthermore, the control device 55 is connected to the main drive motor 52 and the plate feeding and removal units 48-51. A switchable stepup gear mechanism 65-68 is provided in every printing unit 1-4 in the drive gear train between the impression cylinders 11, 15, 19, 23 and the plate cylinders 36-39. The stepup gear mechanisms 65-68 likewise have a connection to the control device 55. Clutches which can be actuated remotely and, upon an actuating signal, bring about a changeover of the stepup ratios of the stepup gear mechanisms 65-68 are situated in the stepup gear mechanisms 63-68.

If designations which have already been introduced are used in the following description, they denote elements or symbols with an equivalent function or meaning.

Figure 2:
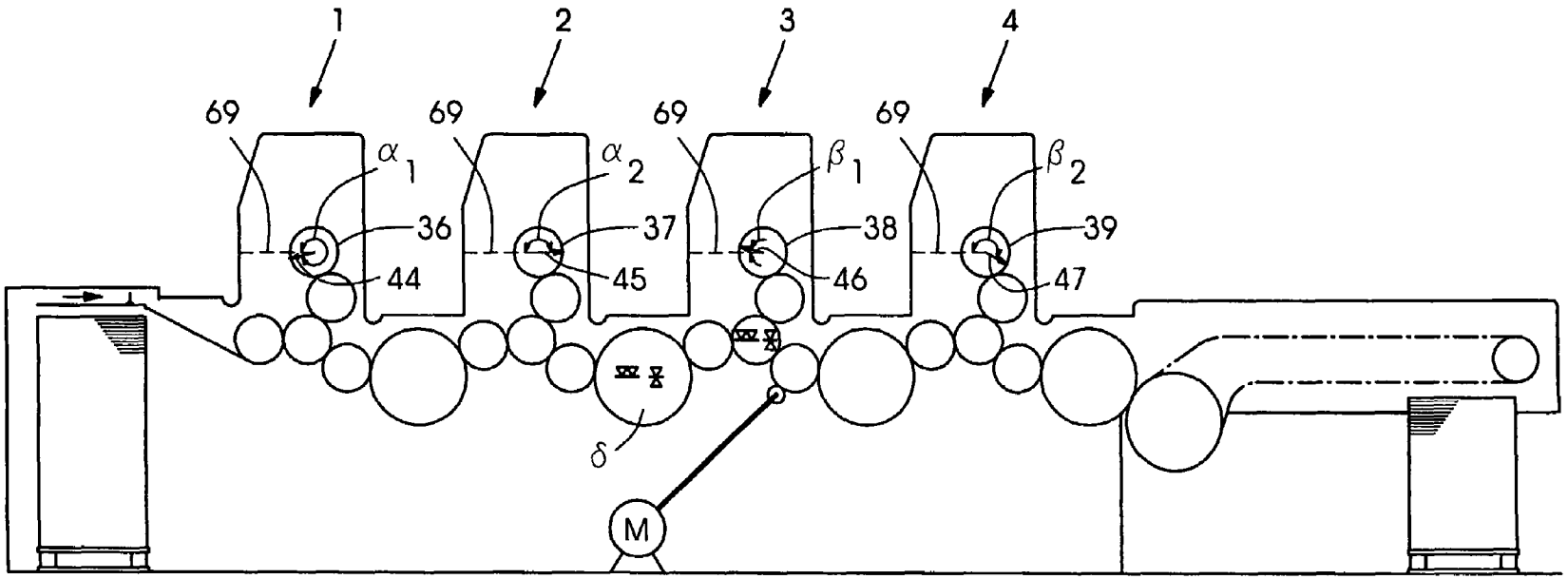
FIG. 2 is a more simplified diagram for the rotational phase position of plate cylinders during printing.

FIG. 2 shows the rotational phase positions $\alpha 1$, $\alpha 2$, $\beta 1$, $\beta 2$ of the plate cylinders 36-39 during printing with regard to a horizontal 69, in greater detail. There is a phase offset $\gamma=\alpha 1-\alpha 2$ between the plate cylinders 36, 37 of the printing units 1, 2 ahead of the turner apparatus. The turner apparatus can be adjusted from printing on one side of a sheet 7 to double-sided printing. In accordance with the length of the sheets 7, the printing units 1, 2 ahead of the turner apparatus are set with a phase offset 5 with respect to the printing units 3, 4 after the turner apparatus. This results in a rotational phase position $\beta 1$, where $\beta=\alpha 2+\gamma$, for printing unit 3 during printing. During printing on both sides of a sheet 7 and with turner operation switched on, the printing unit 3 has a rotational phase position $\beta 1=\alpha 2+\gamma+\delta$. There is likewise a phase offset $\gamma$ between the printing units 3, 4.

Figure 3:
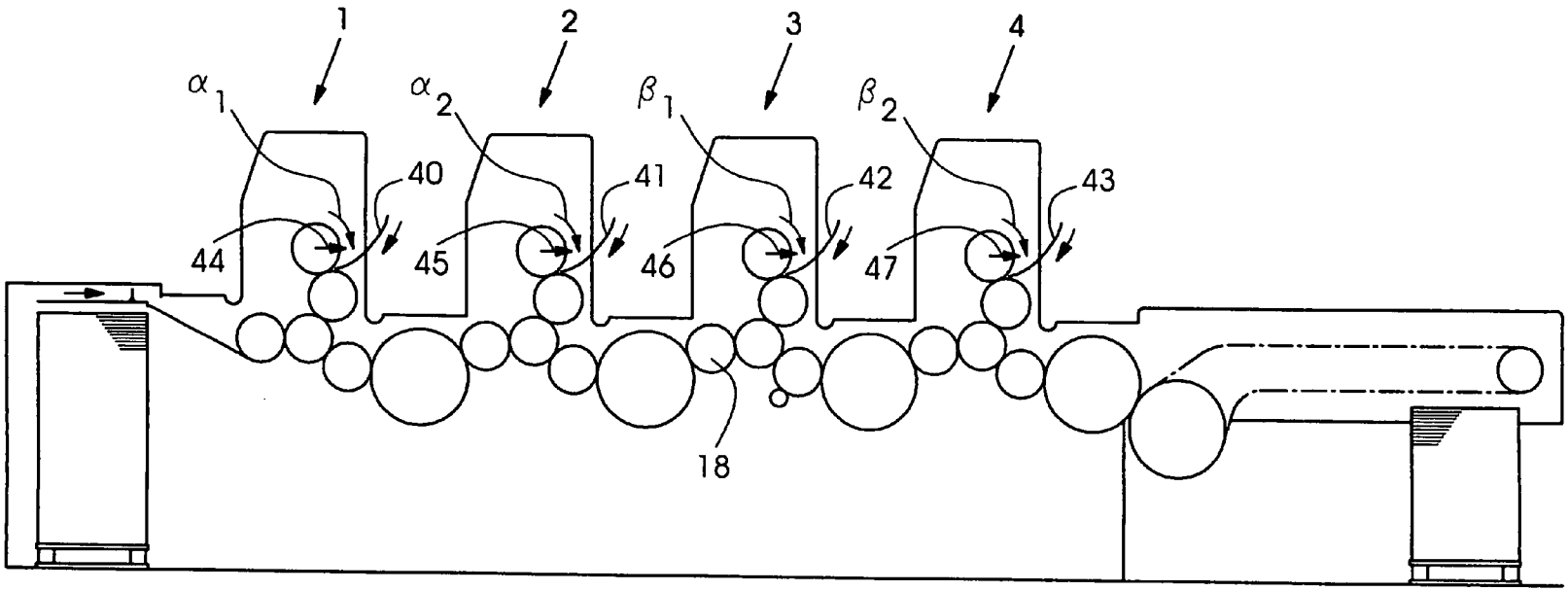
FIG. 3 is a similar diagram of an offset printing press with plate cylinders that are adjusted so as to be in phase with one another.

For simultaneous changing of the printing plates 40-43 in all the printing units 1-4, the plate cylinders 36-39 are adjusted into the same rotational phase, which is shown in greater detail in FIG. 3. If the offset printing press was set to double-sided printing during processing of a print job, the gear train ahead of the turner drum 18 has to be rotated during phase alignment by a defined angle with respect to the gear train after the turner drum 18. This angle is dependent on the length of the sheets 7. As a result of this rotation, the relative angular position of the plate cylinders 36-39 in the printing units 1, 2 and 3, 4 ahead of and behind the turner drum 18, respectively, changes with respect to one another.

The stepup gear mechanisms 65-68 with the clutches which can be actuated remotely make a disengagement possible in the torque flow, optionally between the plate cylinders 36-39 and the transfer cylinders 28-31 or between the transfer cylinders 28-31 and the impression cylinders 11, 15, 19, 23. It is therefore possible that, during a plate change and/or during cleaning processes, the plate cylinders 36-39 and the transfer cylinders 28-31 are not in the phase position which they assume during printing.

Figure 4:
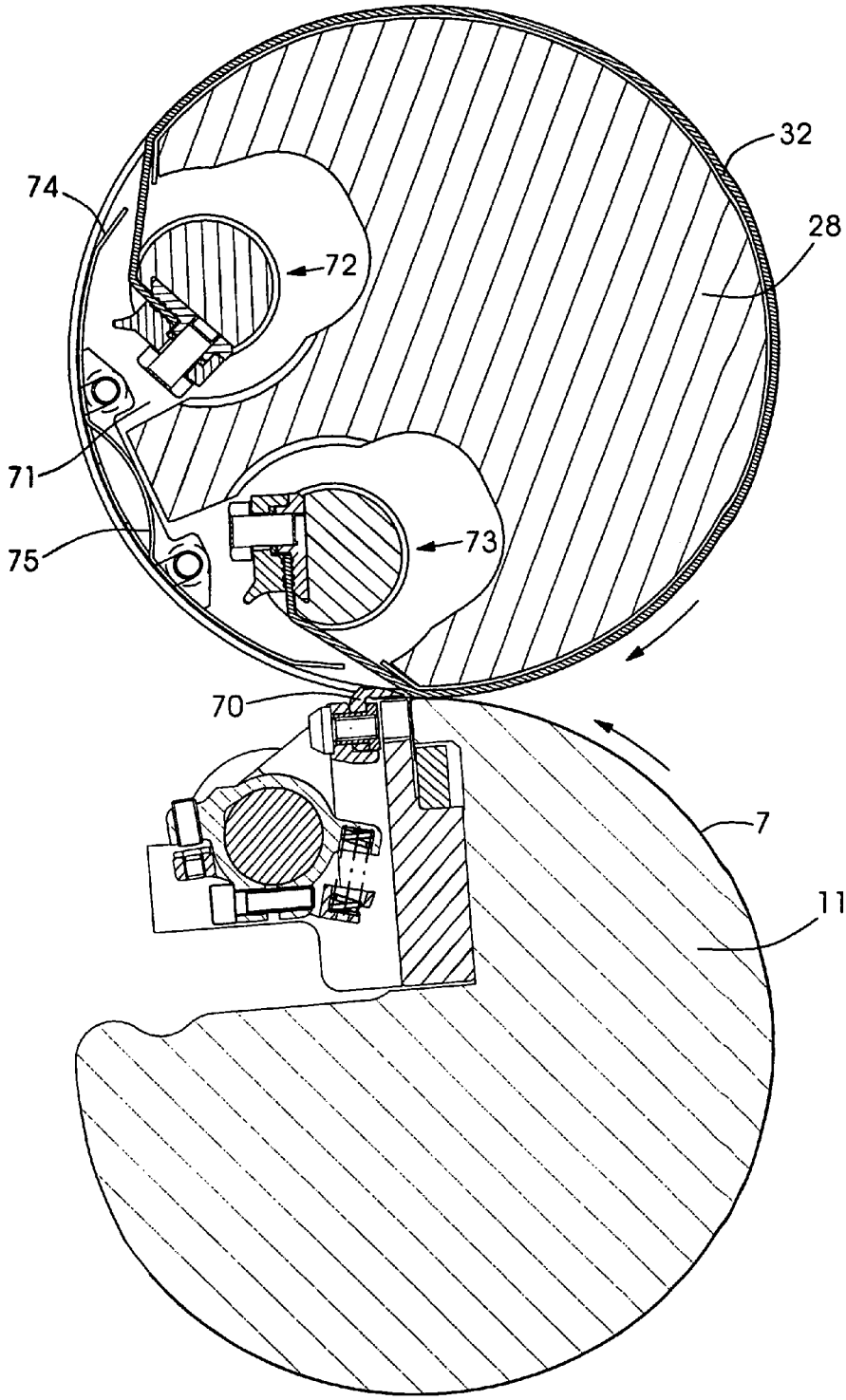
FIG. 4 is a section taken through a transfer cylinder and an impression cylinder.

FIG. 4 uses the example of the impression cylinder 11 and the transfer cylinder 28 to show how the cylinders are situated with respect to one another during printing operation. The grippers 70 of the impression cylinder 11 hold a sheet 7 at the leading edge. The grippers 70 lie higher in the radial direction than the circumferential surface of the impression cylinder 11, which circumferential surface forms the contact surface for the sheet 7. Holding and clamping apparatuses 72, 73 for the rubber blanket 32 are situated in the channel 71 of the transfer cylinder 28. The channel 71 is bridged by a cover 74. During printing, the cover 74 lies under the circumferential contour of the transfer cylinder 28.

Figure 5:
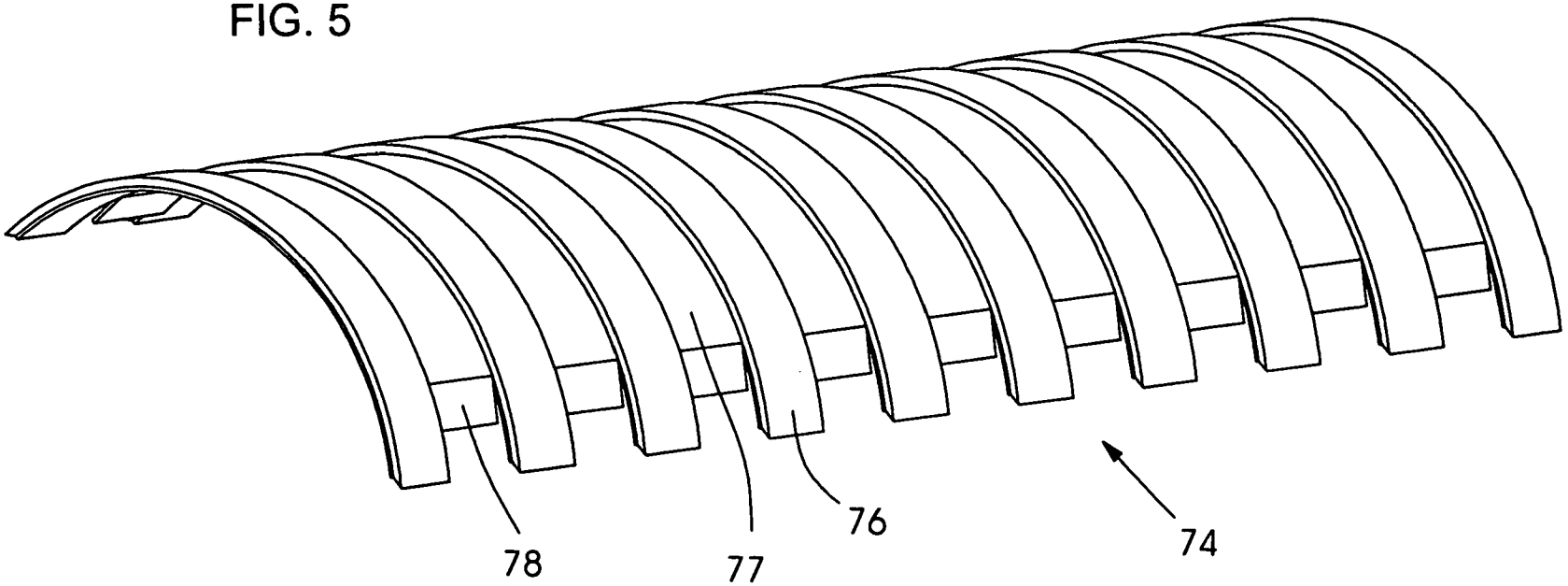
FIG. 5 is a perspective view of a channel cover of a transfer cylinder.

The construction of the cover 74 can be seen in greater detail from FIG. 5. The cover 74 comprises a frame 75, on which support strips 76 are arranged which extend in the circumferential direction of the transfer cylinder 28. There are cutouts or depressions 77 for the gripper tips of the grippers 70 between the support strips 76. The depressions 77 are provided with ramps 78 in the region of the channel edges of the transfer cylinder 28. It is therefore possible to rotate the impression cylinder 11 without gripper collision in the event of a stationary transfer cylinder 28 of a printing unit which has been rendered nonoperational. Here, the transfer cylinder 28 with the cover 74 is situated in a rotational position, in which the grippers 70 dip into the depressions 77.

The support strips 76 are of hollow configuration and are made from an elastic material. The support strips 76 expand radially outward when compressed air is applied to them. It is therefore possible to adjust the support surfaces of the support strips 76 to the radial level of the rubber blanket. In the extended position, the support strips 76 serve as a pressing element against the circumferential surface of the plate cylinder 36 when a new printing plate 40 is being pressed on.

This application claims the priority, under 35 U.S.C. § 119, of German Patent Application DE 10 2005 041 337.4, filed on Aug. 31, 2005; the prior application is herewith incorporated by reference in its entirety.

I claim:

1. A device for pressing on a flexible printing form when it is being pulled onto a form cylinder of an offset printing press, the press having an offset cylinder, an axially parallel form cylinder, and an axially parallel impression cylinder, the device comprising:

a switching-on or switching-off apparatus of the offset cylinder with respect to the form cylinder and the impression cylinder;

the offset cylinder having a channel formed therein, and a cover disposed above said channel;

the impression cylinder having a gripper system for sheets, the gripper system protruding beyond a circumferential contour of the impression cylinder and dipping into said channel formed in the offset cylinder during printing;

said cover having a surface formed with support surfaces for supporting the printing form and supplementing a contour of the offset cylinder, and said cover having depressions formed therein lying deeper than said support surfaces and extending in the circumferential direction, enabling the gripper system to dip into said depressions.

2. The device according to claim 1, wherein said support surfaces are disposed to be adjusted radially into two different positions.

3. The device according to claim 2, wherein said support surfaces are pneumatically or hydraulically adjustable.

4. The device according to claim 2, wherein said support surfaces are mounted to be adjusted mechanically.

5. The device according to claim 1, wherein said support surfaces of said cover are formed from a compliant elastic material.

6. The device according to claim 1, wherein said cover has a symmetrical configuration.

* * * * *